US011007103B2

(12) United States Patent
Custeau-Boisclair et al.

(10) Patent No.: US 11,007,103 B2
(45) Date of Patent: May 18, 2021

(54) LOCKING CLIP FOR PATIENT SLING

(71) Applicant: ArjoHuntleigh Magog Inc., Magog (CA)

(72) Inventors: Olivier Custeau-Boisclair, Sherbrooke (CA); Martin Faucher, Magog (CA); Marie-Lou Joncas, St-Denis de Brompton (CA); Yvan Matteau, Sherbrooke (CA); Erick Calderon, Canton de Hatley (CA)

(73) Assignee: ArjoHuntleigh Magog Inc., Quebec (CA)

( * ) Notice: Subject to any disclaimer, the term of this patent is extended or adjusted under 35 U.S.C. 154(b) by 722 days.

(21) Appl. No.: 15/540,617

(22) PCT Filed: Dec. 30, 2015

(86) PCT No.: PCT/CA2015/051381
§ 371 (c)(1),
(2) Date: Jun. 29, 2017

(87) PCT Pub. No.: WO2016/106455
PCT Pub. Date: Jul. 7, 2016

(65) Prior Publication Data

US 2018/0021195 A1 Jan. 25, 2018

Related U.S. Application Data

(60) Provisional application No. 62/097,885, filed on Dec. 30, 2014.

(51) Int. Cl.
*A61G 7/10* (2006.01)

(52) U.S. Cl.
CPC ..... *A61G 7/1078* (2013.01); *A61G 7/1051* (2013.01); *A61G 7/1061* (2013.01)

(58) Field of Classification Search
CPC .. A61G 7/1078; A61G 7/1051; A61G 7/1061; F16B 21/09; F16B 21/12;
(Continued)

(56) References Cited

U.S. PATENT DOCUMENTS 3,688,012 A * 8/1972 Vettel ..... G10G 5/005 84/327
4,271,999 A * 6/1981 Stravitz ..... A44B 11/2584 224/257
(Continued)

FOREIGN PATENT DOCUMENTS

CA 2489047 A1 * 6/2006 ..... A61G 7/1049
FR 2110501 A5 6/1972
(Continued)

*Primary Examiner* — David R Hare
*Assistant Examiner* — Alexis Felix Lopez
(74) *Attorney, Agent, or Firm* — The Webb Law Firm

(57) ABSTRACT

A locking clip for attaching a patient sling to a spreader bar includes a first attachment site for accepting an attachment element mounted on either the sling or the spreader bar, a second attachment site for attaching the device to the other of the sling or the spreader bar, and at least one locking element for locking the attachment element in place. The clip also includes a release mechanism to allow removal of an attachment element and is configured to allow rotation of the attachment element when it is locked in place so that the sling can be rotated relative to the spreader bar.

16 Claims, 8 Drawing Sheets

(58) Field of Classification Search
CPC ..... F16B 21/125; F16B 2/20; F16B 2/205; A44B 11/2584; Y10T 24/45796
See application file for complete search history.

(56) References Cited

U.S. PATENT DOCUMENTS

| | | | | | |
|---|---|---|---|---|---|
| 5,644,805 | A * | 7/1997 | Horcher | ..... | A61G 7/1015 5/86.1 |
| 7,367,091 | B2 * | 5/2008 | McWattie | ..... | A61G 7/1051 24/194 |
| 7,818,851 | B2 * | 10/2010 | Perrotta | ..... | A45F 3/14 24/265 BC |
| 2005/0088004 | A1 * | 4/2005 | Van Scheppingen | ..... | A61G 7/1017 294/81.3 |

FOREIGN PATENT DOCUMENTS

| | | | | | |
|---|---|---|---|---|---|
| GB | 2293857 | A | 4/1996 | | |
| GB | 2402920 | A * | 12/2004 | ..... | A61G 7/1051 |
| GB | 2513369 | A * | 10/2014 | ..... | A61G 7/1078 |
| WO | 2007035098 | A2 | 3/2007 | | |
| WO | WO-2008132472 | A1 * | 11/2008 | ..... | A61G 7/1078 |

* cited by examiner

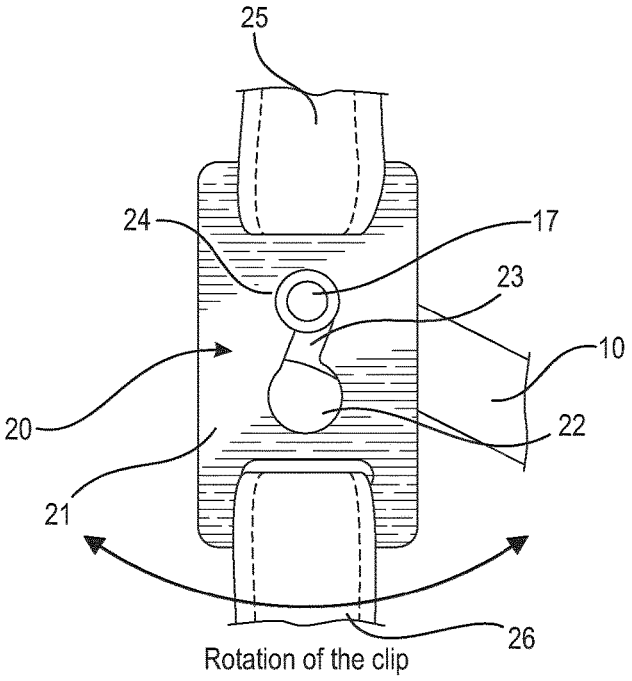
FIG. 2A
(Prior Art)
FIG. 2B
(Prior Art)
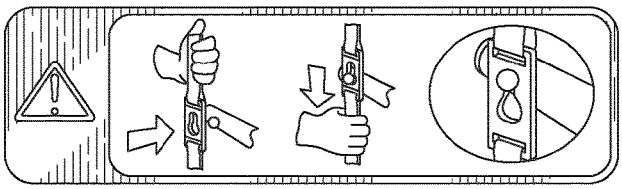
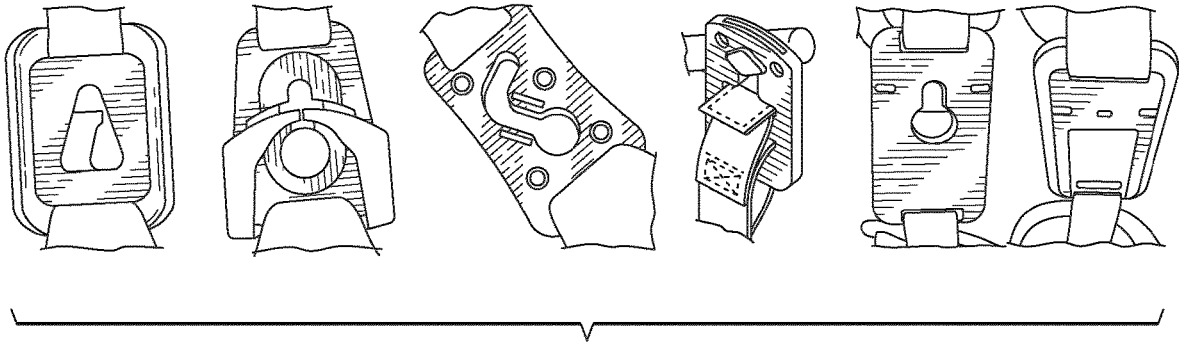
FIG. 2C
(Prior Art)

LOCKING CLIP FOR PATIENT SLING

CROSS-REFERENCE TO RELATED APPLICATIONS

This application is the United States national phase of International Application No. PCT/CA2015/051381 filed Dec. 30, 2015, and claims priority to U.S. Provisional Patent Application No. 62/097,885 filed Dec. 30, 2014, the disclosures of which are hereby incorporated in their entirety by reference.

TECHNICAL FIELD OF THE DISCLOSURE

The present disclosure relates to an attachment device for attaching a patient sling to a spreader bar, and also to a sling and/or a spreader bar incorporating the attachment device.

BACKGROUND OF THE DISCLOSURE

In the field of patient handling, there are many different accessories that can be used to transfer a patient. In many situations, the patient is moved from a bed to a chair, and vice versa. So, once the patient is raised, he is repositioned during the transfer to bring him from a lying position (i.e., from a bed) to a sitting position (i.e., to a chair). There are specific accessories that allow repositioning the patient during the transfer, which are referred to as spreader bars. There are many types of spreader bars: flat or open, manual or powered. But they all work in much the same way.

In order to allow rotation of the patient in the sling when suspended from the spreader bar, the sling may be attached to the spreader bar with four clips. Clips are used instead of textile loops to prevent wear of the loops. In order to allow rotation of the patient, a clip is provided that rotates around a knob (instead of a textile loop that slides in a hook).

All clips on the market currently need a double action (see FIG. 1) to lock the clip in place. The two actions needed include: seating the clip over the knob on an accessory; and pulling it down to secure it to an accessory.

The problem with these two actions is that the caregiver can carry out the first action (i.e., seating the clip over the knob) without carrying out the second action, thereby leaving the clip unsecured. With any movement of the patient or movement of the accessory, the clip can come off. If this is not noticed by the caregiver and the transfer is initiated, this situation can lead to a patient fall.

Another problem with existing clips is the release mechanism. There are two types of release mechanisms: (i) some clips that only have a restriction in a slot to make it harder to remove, and (ii) other clips that are physically locked in place. A specific action is needed to unlock the release mechanism and remove the clip. In both situations, it is possible to involuntary remove the clip. Patient movement in the sling (for example, a knee kick or an elbow kick) can result in the clip or the release mechanism being struck, thereby resulting in the clip becoming unlocked. Once the clip is unlocked it can come off and result in a patient fall.

The main problems with prior art devices therefore include: an absence of a locking device in the clip; when there is a locking device in the clip, these clips typically involve the user taking a second step/action to lock the clip in place; and release mechanisms that can be easily activated by mistake, in part due to their relatively large size and user accessibility.

US 2005/0088004 A1 (Van Scheppingen et al.) discloses a patient hoist device that incorporates an attachment clip. In order to attach this clip, two actions are needed.

FIGS. 1A and 1 B show a prior art system including a spreader bar 10 and a patient sling 15, which can be coupled together to allow rotation of the patient from a lying to a seated position and vice versa (spreader bar 10 in FIG. 1A is actually a different model to that shown in FIG. 1 B). Spreader bar 10 has two lateral fixing points 11 and centre fixing point 12 to which sling 15 can be attached. Spreader bar 10 can be attached to a hoist (not shown) at fixing point 13.

A prior art clip for attaching sling 15 to spreader bar 10 is shown in FIG. 2A. Clip 20 includes a flat planar rectangular body 21 to which suspension straps 25 and 26 are attached at either end. Between the straps 25 and 26 attachment hole 22 is formed in body 21 and this is connected to locking hole 24 by channel 23.

It can be seen from FIG. 2A that spreader bar 10 has knob 17 mounted thereon. Knob 17 projects from spreader bar 10 on a shaft (not shown), which is narrower in diameter than the head of knob 17. The diameter of knob 17 is sufficiently small to fit through attachment hole 22, but is too large to fit through locking hole 24. Accordingly, in order to attach clip 20 to spreader bar 10, knob 17 is fitted through attachment hole 22 and clip 20 is then moved laterally relative to spreader bar 10 in order that the shaft of knob 17 passes through channel 23 to become seated in locking hole 24. Clip 20 can then be rotated relative to spreader bar 10 as shown in FIG. 2A.

This fitting method is shown schematically in FIG. 2B, which illustrates a slightly different clip to that of FIG. 2A. Further prior art clips, which work in the same manner, are shown in FIG. 2C.

Although clip 20 is relatively easy to fit to spreader bar 10, it will be appreciated that it could become unmounted if movement of the patient in sling 15 results in upward movement of clip 20 relative to spreader bar 10.

SUMMARY OF THE DISCLOSURE

The present disclosure seeks to provide an improved attachment device for attaching a patient sling to a spreader bar.

According to a first embodiment of the present disclosure, there is provided an attachment device for attaching a patient sling to a spreader bar, wherein the device includes a first attachment site for accepting an attachment element mounted on either the sling or the spreader bar, a second attachment site for attaching the device to the other of the sling or the spreader bar, a locking element for locking an attachment element in place in the first attachment site, wherein the locking element is configured to allow movement of an attachment element along an axis of movement into the first attachment site but to prevent removal of an attachment element from the first attachment site, and a release mechanism that is operable to allow removal of an attachment element, wherein the device is configured to allow rotation of an attachment element about the axis when an attachment element is locked in place in the first attachment site.

According to another embodiment of the present disclosure, there is an attachment device for attaching a patient sling to a spreader bar. The device includes a first attachment site attachable to an attachment element of the sling or the spreader bar, and a second attachment site attachable to the other of the sling or the spreader bar. A locking element of the device locks the attachment element to the first attachment site automatically and immediately upon initial connection of the attachment element to attachment site, wherein the locking element is configured to allow movement of the attachment element along an axis of movement into the first attachment site, and the locking element prevents removal of the attachment element from the first attachment site.

The structure of the device allows the device to be mechanically locked to an attachment element with a single action, but two separate steps or actions are involved in order to be unlocked (namely operation of the release mechanism followed by removal of the attachment element). It also allows rotation of the attachment element when locked in place, which is necessary in order to be able to rotate the patient relative to the spreader bar.

In one embodiment, the device is formed generally on a plane, and the axis of movement of the attachment element into the first attachment site is substantially perpendicular to the plane. This allows straightforward attachment of the sling to the spreader bar in a single action.

In one embodiment, the locking element is configured to move from a first position in which it restricts access to the first attachment site to a second position in which it allows access to the first attachment site, and wherein it is resiliently biased into the first position.

In one embodiment of this disclosure, the locking element is configured to rotate about an axis substantially perpendicular to the axis of movement in order to move from the first position to the second position. This is known as a "rotary latch." In another embodiment of this disclosure, the locking element is configured to move laterally along an axis substantially perpendicular to the axis of movement in order to move from the first position to the second position. This is known as a "sliding latch."

As noted above, removal of the device necessitates a double action, first to operate the release mechanism and then to remove the attachment element from the first attachment site. In one embodiment of this disclosure, operation of the release mechanism moves the locking element from the first to the second position. Alternatively, operation of the release mechanism removes the resilient bias to allow the locking element to move from the first to the second position. For example, the release mechanism may include a handle that is pulled or a knob that is rotated by the user with either action releasing the locking element and allowing removal of the device from the attachment element in a second action. In this embodiment of the disclosure, the release mechanism is mechanically or electrically connected to the locking element.

In an alternative embodiment of this disclosure, operation of the release mechanism allows the attachment element to move out of the first attachment site in a direction substantially perpendicular to the axis of movement, thereby bypassing the locking element. For example, the attachment device may include a channel in communication with the first attachment site along which the attachment element is able to move in order to bypass the locking element. In this embodiment of the disclosure, the locking element can remain locked in place but the operation of the release mechanism enables the attachment element to be removed from the first attachment site via a different route.

The attachment device may include a second locking element, and the two locking elements may be arranged at about 180° about the first attachment sites.

In a second embodiment of the present disclosure, there is provided a kit of parts including an attachment device as defined above and an attachment element for attaching to the device. In one embodiment, the attachment element is a knob having a flange and a recess portion. The locking element may be configured to be seated in the recess portion when the attachment element is locked in the first attachment site. Both the attachment element and the first attachment site may be circular in cross-section.

The attachment element may be attached to a spreader bar and the attachment device may be attached to a patient sling, or vice versa.

In a further embodiment of the disclosure, a patient sling is provided to which is attached an attachment device as defined above. Alternatively, a patient spreader bar may be provided to which is attached an attachment device as defined above.

BRIEF DESCRIPTION OF THE DRAWINGS

A number of preferred, non-limiting embodiments of the present disclosure will now be described, with reference to the drawings, in which:

FIGS. 2A-2C show prior art clips for use on, for example, the system of FIGS. 1A and 1B;

DESCRIPTION OF NON-LIMITING ILLUSTRATIVE EMBODIMENTS

Figure 1A:
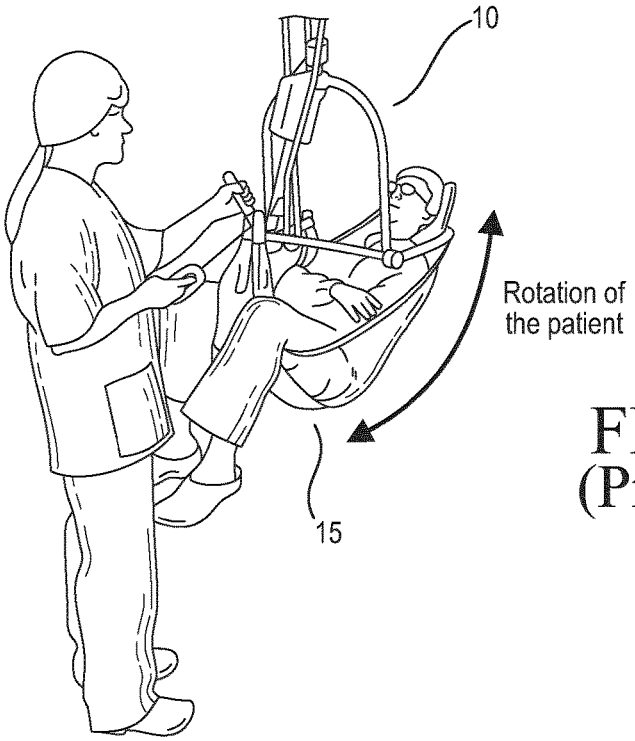
FIG. 1A (Prior Art)
FIGS. 1A and 1B are schematic diagrams of prior art spreader bar and sling systems.
Figure 1B:
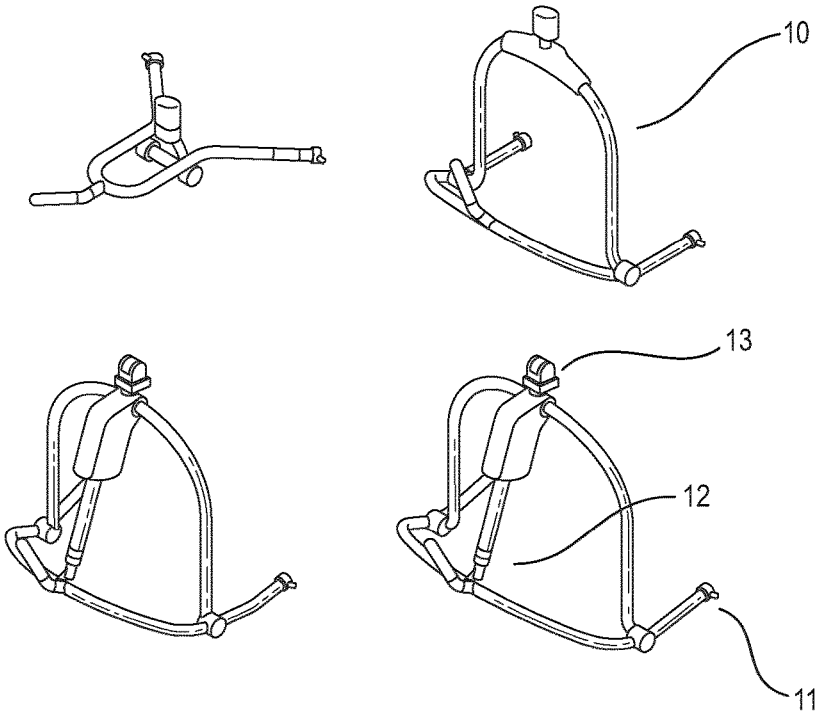
FIG. 1B (Prior Art)
Figure 3A:
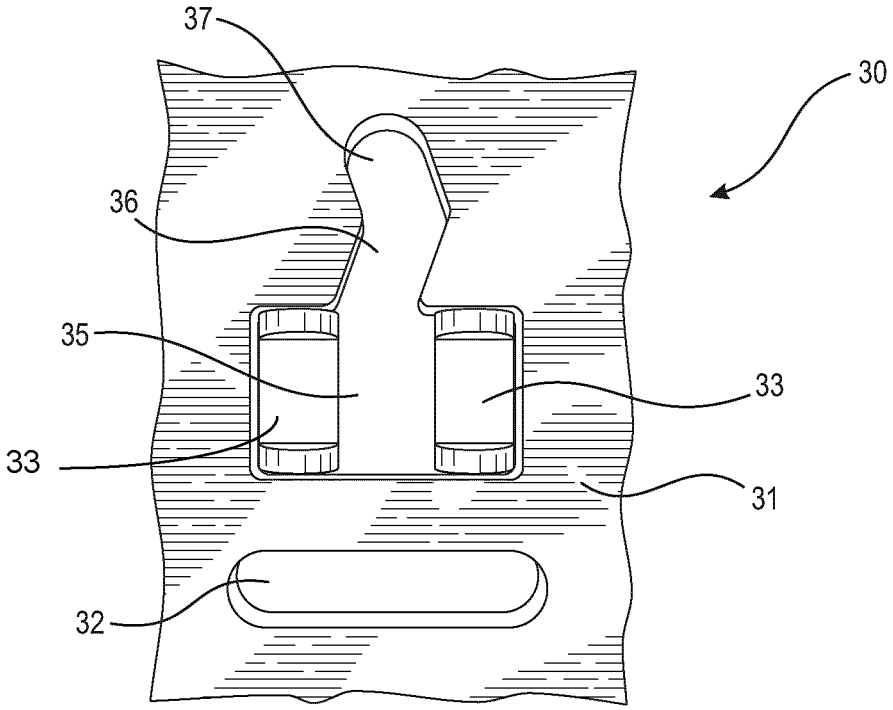
FIGS. 3A and 3B show one embodiment of a clip of the present disclosure.
Figure 3B:
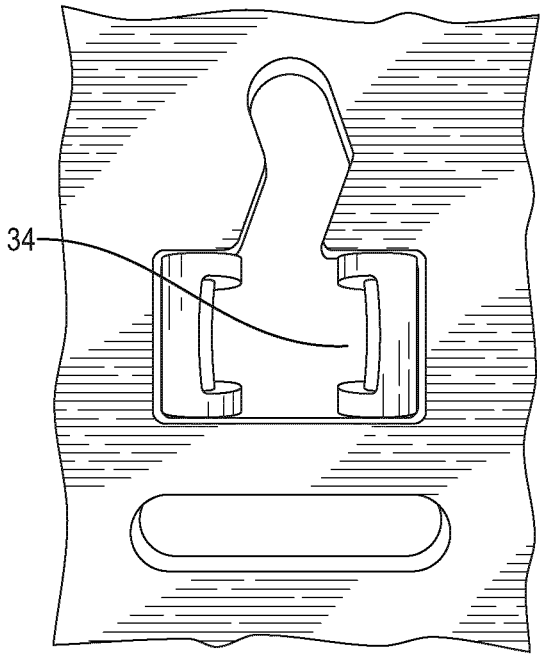
Figure 4:
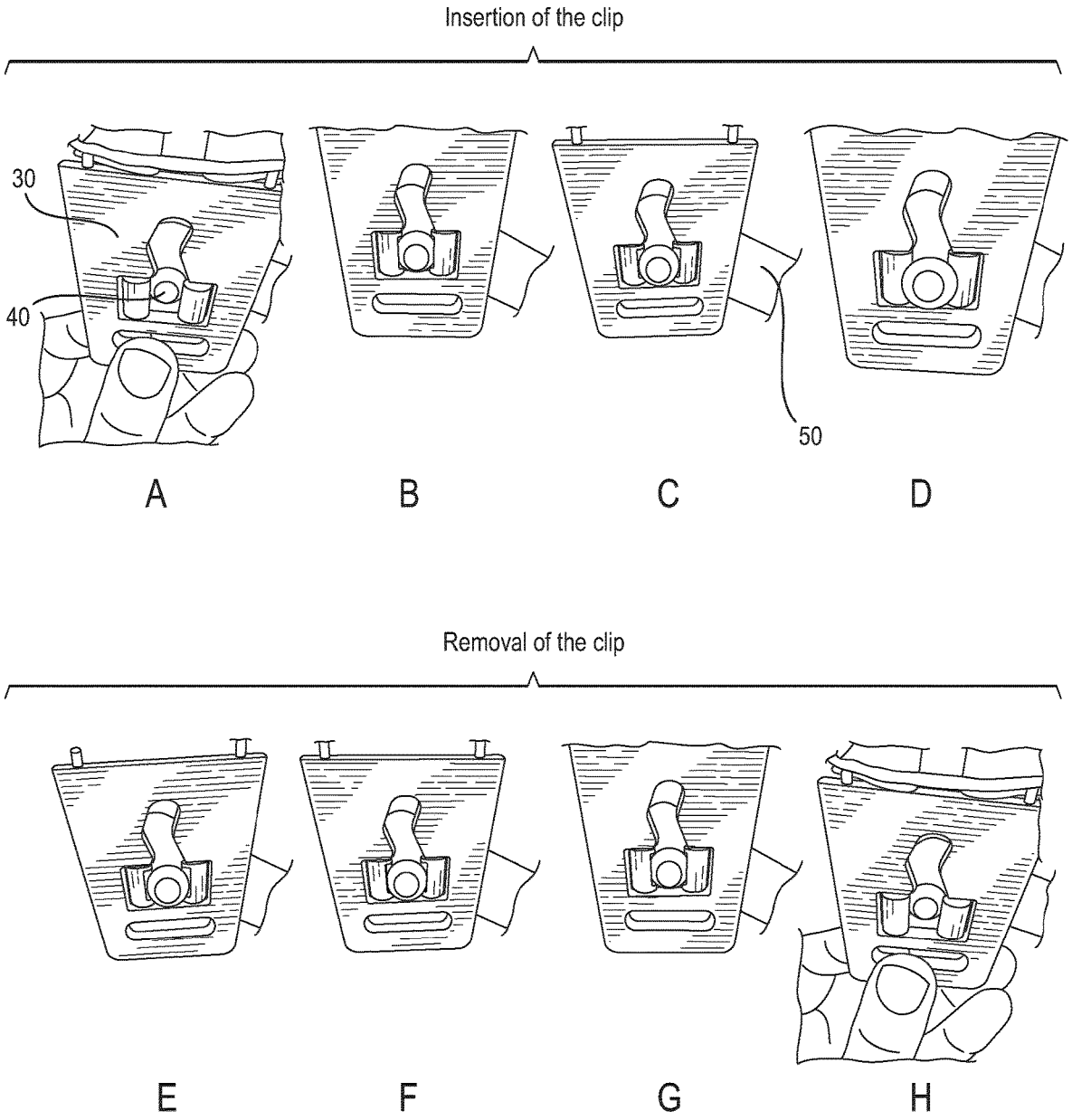
FIGS. 4A-4H show stages of operation of the clip of FIGS. 3A and 3B.

An exemplary embodiment of a clip in accordance with this disclosure is shown in FIGS. 3A and 3B, and the use of such a clip is illustrated in FIG. 4.

Turning first to FIGS. 3A and 3B, clip 30 comprises a generally flat rectangular body 31 having slot 32 to which a strap can be attached (not shown). Two latches 33 are disposed on either side of rectangular aperture 35. Latches 33 are each pivotally mounted on separate shafts (not shown), which passes through the center of each latch and into clip body 31. Latches 33 are free to rotate about the shaft with the axis of rotation lying in the plane of clip body 31.

In one embodiment, latches 33 may have a generally cylindrical in shape, each including a notch 34 configured to engage and conforming to a portion of a spreader bar 99, 109 connector 95, 105. In the embodiment shown in FIG. 3B, notch 34 has a cut-out cuboidal configuration in one side of each latch 33 that faces the opposite latch. Accordingly, it can be seen that rotation of latches 33 rotates notches 34 so as to face each other across aperture 35, thereby increasing the effective width of aperture 35 by double the depth of each notch 34. Rotation of latches 33 by 90°-270° narrows the effective width of aperture 35 to a width that is equal to the natural width of aperture 35 minus the diameters of latches 33. When the latches 33 are in these positions the latches may be referred to as in the "closed" configuration. A spring mechanism (not shown) of the clip 30 biases latches 33 into the configuration shown in FIG. 3A, which is one of the closed configurations. A release mechanism (not shown) of the clip 30 rotates latches 33 against the bias of the spring mechanism into the "open" configuration (see FIG. 3B) in which notches 34 face each other.

Clip body 31 also has angled slot 36 in communication with aperture 35 at one end and a terminus opening 37 at the other end. In one embodiment, aperture 35, slot 36 and terminus opening 37 may form a keyhole opening. The function of this structure will be described below.

As best shown in FIGS. 9A-11, clip 30, 50, 70 may be part of a patient transfer or lift system in which one or more clips 30, 50 or 70 are operably associated with a connector 95, 105 of a spreader bar 99, 109 and/or a strap, belt or portion of a patient sling 15. By way of example, the connector 95, 105 may be integral with, attached to, extending from and/or otherwise mounted on spreader bar 99, 109. The connector 95, 105 may be configured to engage and be secured to aperture 35, 55, 75, slot 36, 76 and/or terminus 37, 77. In an exemplary embodiment, the connector 95, 105 may be configured as a protrusion, knob, hook or catch. An attachment member of patient sling 15, such as a belt, strap, loop, pocket or folded surface, may be operably associated with one or more clips 30, 50 or 70 securing it to the patient sling. In one embodiment, the attachment member of patient sling 15 may be inserted through, coupled to or otherwise attached to slot 32, 52, 72 of clips 30, 50 or 70.

FIGS. 4A-4D illustrate one embodiment in which mounting of clip 30 on a connector, configured as knob 40, and FIGS. 4E-4H illustrate the removal of clip 30 from knob 40. Knob 40 is as described above in relation to FIG. 2A.

In FIG. 4A, clip 30 is presented to knob 40 and is positioned so that knob 40 and aperture 35 are in alignment. In FIG. 4B, clip 30 is pushed towards knob 40 so as to force knob 40 to enter aperture 35 between latches 33. In FIG. 4C, latches 33 rotate against the bias of the spring mechanism until notches 34 become aligned with knob 40, allowing knob 40 to pass through aperture 35 (which has a wider effective width in this position) to emerge on the other side of clip 30.

Once knob 40 has crossed latches 33, the spring mechanism causes latches 33 to return to their initial position (i.e., a closed configuration), so that latches 33 are locked behind knob 40. Thus positioned with a rearward facing ridge of knob 40 abutting latches 33, knob 40 is securely and rotatably locked within aperture 35. This configuration is shown in FIG. 4D.

In order to release clip 30 from knob 40, the user activates the release mechanism in order to rotate latches 33 until notches 34 face each other, as shown in FIG. 4E. The user then aligns apertures 35 with knob 40 and removes clip 30 from knob 40 as shown in FIGS. 4F to 4H.

Optionally, the user can carry out a further locking procedure (not shown) by moving clip 30 laterally relative to knob 40 in order to move knob 40 along channel 36 until it sits in terminus 37. This action can then be reversed in order to move knob 40 back into engagement with latches 33.

It will be appreciated that this mechanism may be configured so that clip 30 is asymmetric, in that knob 40 needs to approach clip 30 from one specific side. In this embodiment, it is therefore not possible to insert the clip from the other side. A connector is therefore limited to engaging clip 30 from one direction and at one access or engagement point through aperture 35. In one embodiment, spring biased latches 33 may be configured to restrict rotation between two specific positions, to and from the closed position shown in FIG. 4A and an open position shown in FIGS. 4B-4C.

A further embodiment of the present disclosure is illustrated in FIGS. 5A-5C and 6A-6G. These Figures show clip 50 having body 51, strap slot 52 and a pair of rotating latches 53 on either side of aperture 55. Latches 53 each have a notch 54 that catches the head of knob 40 in use, as will be described below. A spring mechanism (not shown) biases latches 53 into the locked configuration (see, e.g., FIG. 5C).

Figure 5A:
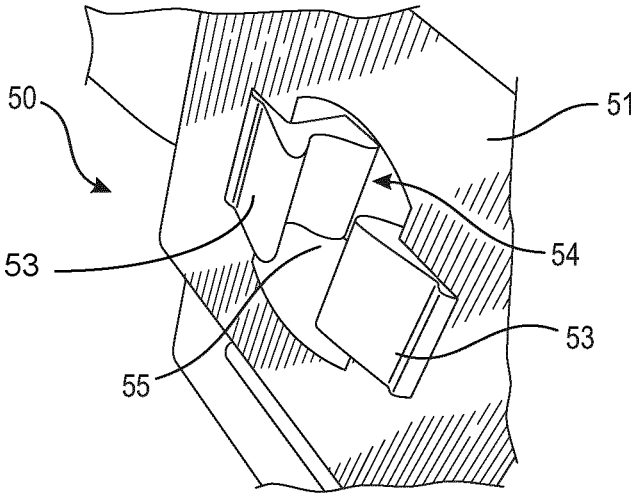
FIGS. 5A-5C show an alternative embodiment of a clip of the present disclosure.
Figure 5B:
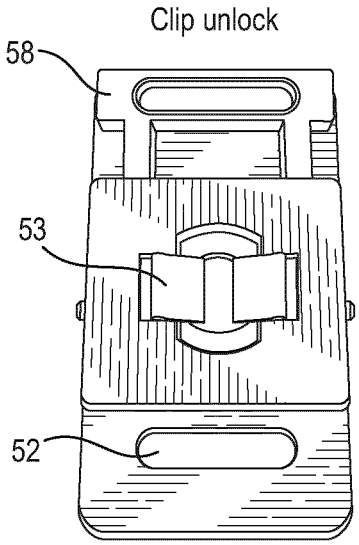
Figure 5C:
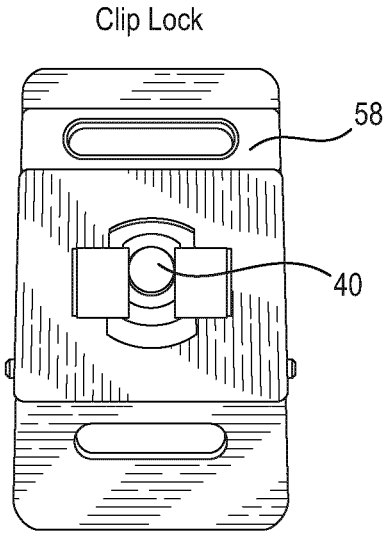

FIGS. 5B and 5C also illustrate release mechanism 58, which is shown in FIG. 5B in an unlocked position in which latches 53 are free to rotate about an axis in the plane of clip body 51. Release mechanism 58 is however spring-biased into a locked position as shown in FIG. 5C in order to prevent rotation of latches 53 and to lock knob 40 in place.

The attachment of clip 50 to knob 40 is now described with reference to FIGS. 6A-6D and the removal of the same described by reference to FIGS. 6E-6G.

Figure 6:
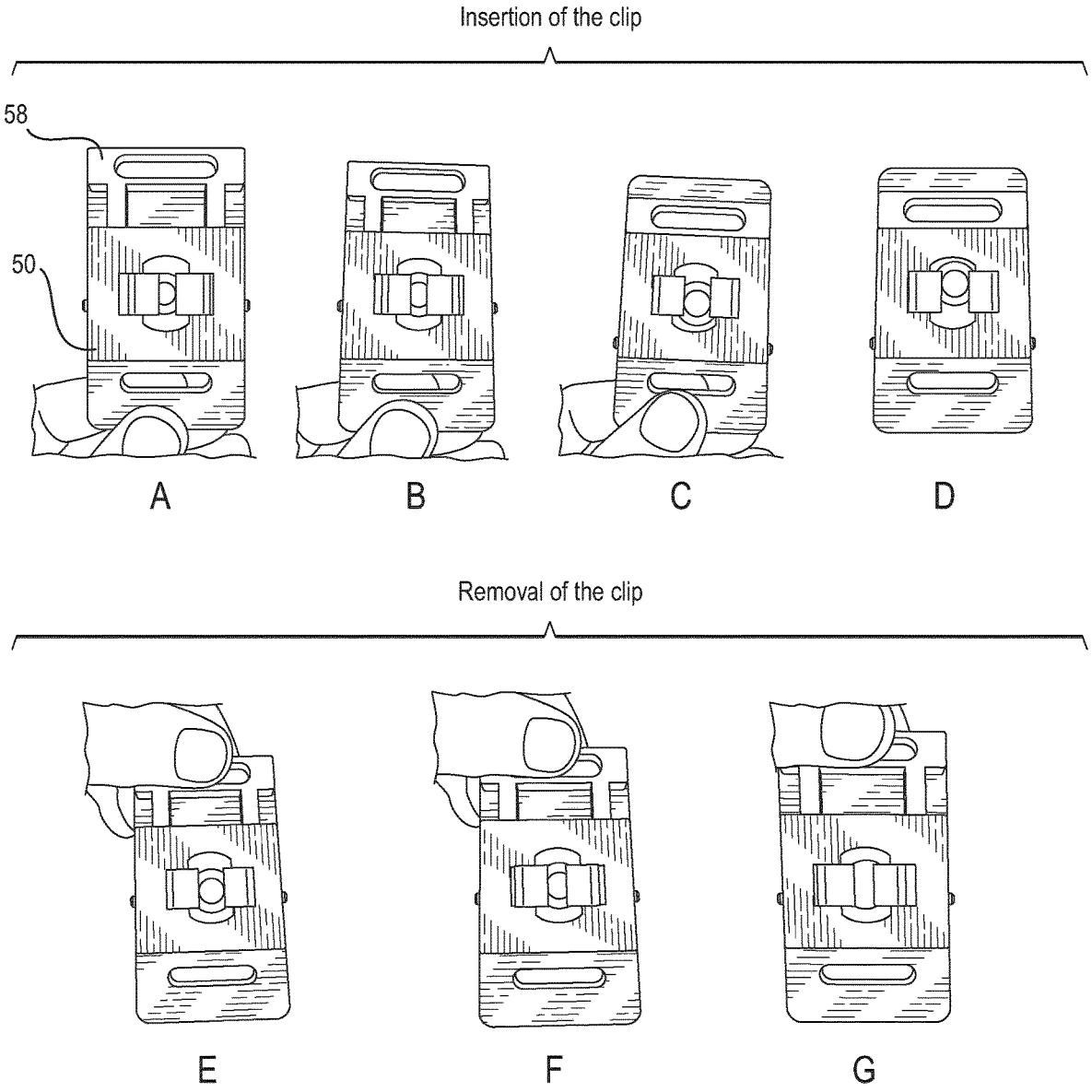
FIGS. 6A-6G show stages of operation of the clip of FIG. 5.

First, release mechanism 58 is moved into the unlocked position and clip 50 is presented to knob 40 so as to align knob 40 with aperture 55 (FIG. 6A). Clip 50 is then pushed so as to force knob 40 to enter aperture 50 between latches 53 (FIG. 6B). Once knob 40 is fully inserted, release mechanism 58 is automatically moved into the locked position in order to lock rotation of latches 53 (FIG. 6C). FIG. 6D shows clip 50 locked in place on knob 40.

In order to remove clip 50, release mechanism 58 is first pulled into the unlocked position in order to unlock rotation of latches 53 as shown in FIG. 6E. Clip 50 can then be pulled away from knob 40, which will slide out whilst rotating latches 53 (FIG. 6F). FIG. 6G shows clip 50 removed from knob 40.

An alternative embodiment of a clip in accordance with this disclosure is illustrated in FIGS. 7A to 7D and 8. This is known as the "sliding latch" embodiment.

Figure 7:
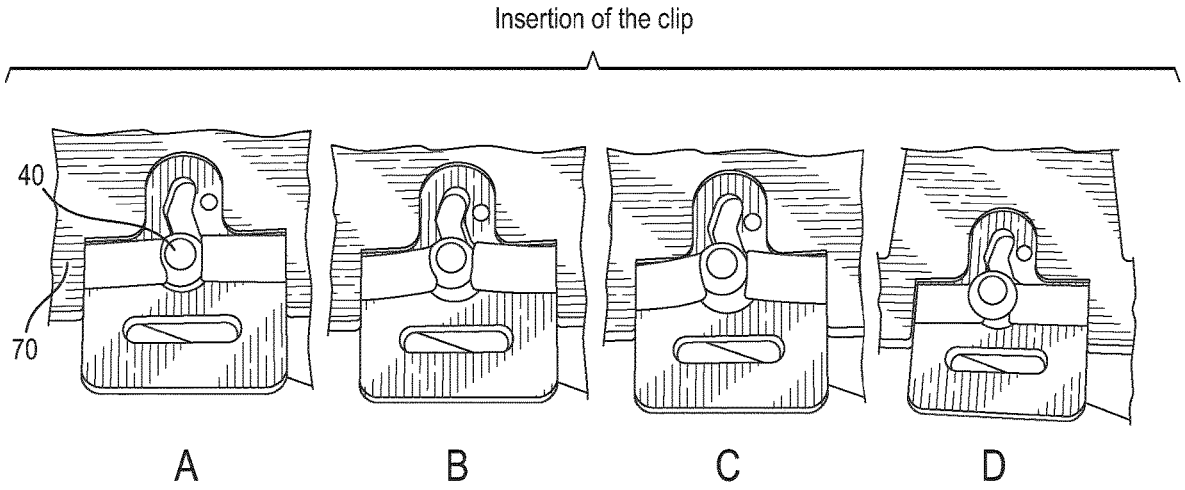
FIGS. 7A-7D show stages of attachment of an alternative embodiment of a clip in accordance with the present disclosure.

As shown in FIGS. 7A to 7D and 8, clip 70 comprises clip body 71 and clip housing 78 in which clip body 71 is slidably mounted. Clip body 71 has strap slot 72 and aperture 75 therein, with aperture 75 in communication with channel 76 and terminus 77. A pair of latches 73 are mounted on clip housing 78 and are aligned with aperture 75 when clip body 71 is in the "locked" position (the left hand image in FIG. 8) and are aligned with channel 76 when clip body 71 is in the "unlocked" configuration (the right hand image of FIG. 8). Latches 73 extend from clip housing 78 towards aperture 75, and may be oriented with respect to clip body 71 to cover opposing portion of aperture 75. In one embodiment, a substantial portion of latches 73 may be supported or backed by a surface of clip body 71, lending strength or rigidity to latches 73. The unattached distal ends of latches 73 extending over a portion of aperture 75 may be movable with respect to clip body 71 and aperture 75 to permit knob 40 to pass therebetween and catch a lip of knob 40 to secure knob 40 within aperture 75. In an exemplary embodiment, latches 73 may be constructed as cantilevered leaf springs, elongate metal member or elongate plastic members. In one embodiment, latches 73 may be constructed and/or configured to substantially prevent withdrawal of knob 40 after it is secured within aperture 75 as shown in FIG. 7D. Clip body 71 can be moved from the locked to the unlocked configuration by sliding it into and out of clip housing 78. Clip housing 78 has release strap 80 at the other end of clip housing 78 to clip body 71.

In order to attach clip 70 to knob 40, clip 70 is presented to knob 40 in its locked state, by aligning aperture 75 with knob 40 (FIG. 7A). Clip 70 is then pushed in order to force knob 40 to enter aperture 75 between spring-loaded latches 73 (FIG. 7B). Further pushing of clip 70 as shown in FIG. 7C will enable knob 40 to cross spring-loaded latches 73 at which point they close behind the head of knob 40 and clip 70 is completely secured to knob 40 (FIG. 7D).

Figure 8:
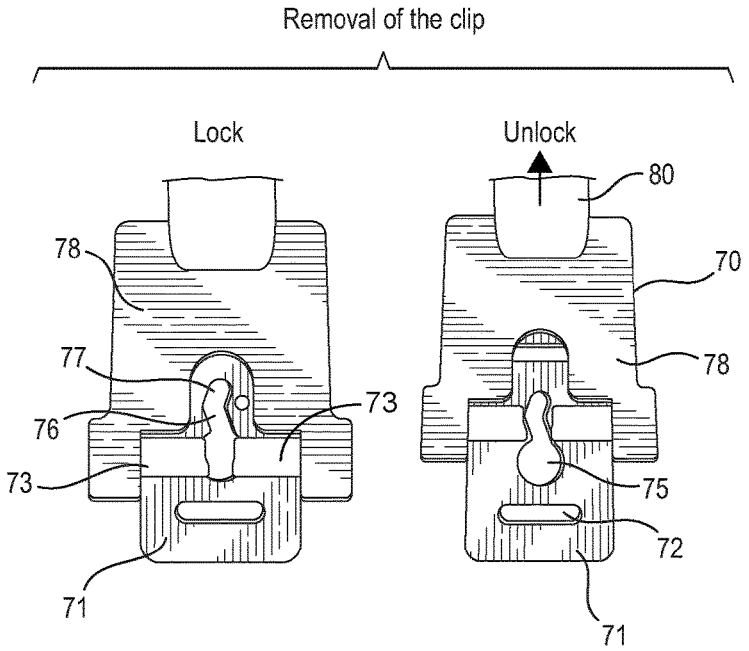
FIG. 8 shows stages of the removal of the exemplary clip of FIG. 7.

In order to remove clip 70 from knob 40, the user pulls on release strap 80 in order to slide clip body 71 out of clip housing 78 and into the unlocked position (see, e.g., right-hand portion of FIG. 8). This brings aperture 75 laterally away from latches 73 at which point clip 70 can be removed from knob 40.

Figure 9A:
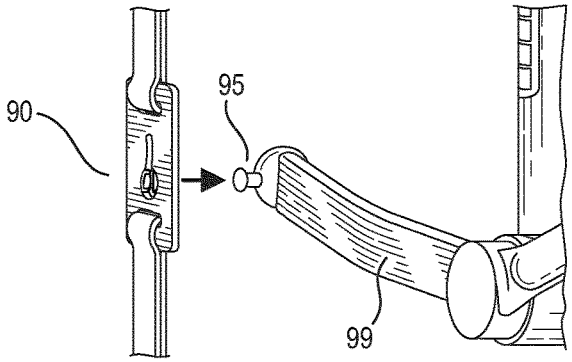
FIGS. 9A-9B are schematic diagrams showing the attachment of a clip in accordance with the present disclosure to a spreader bar frame.
Figure 9B:
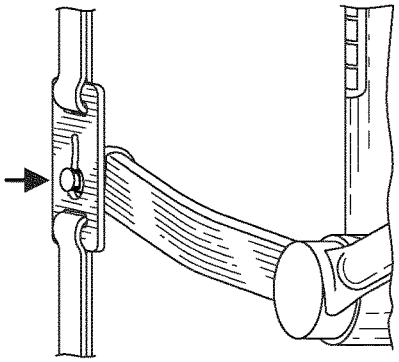
Figure 10A:
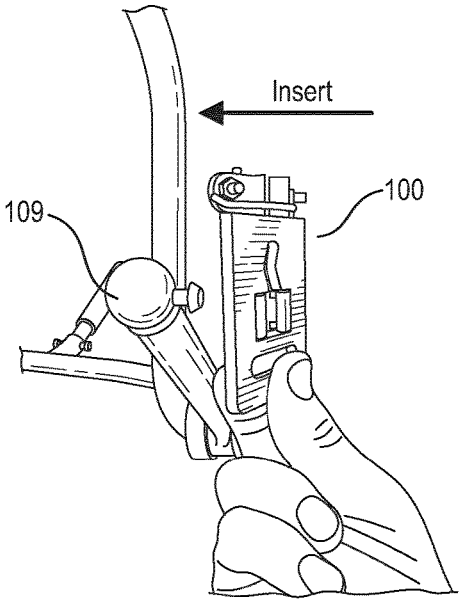
FIGS. 10A-10B are schematic diagrams showing an alternative method of attachment of a clip in accordance with the present disclosure to a spreader bar frame.
Figure 10B:
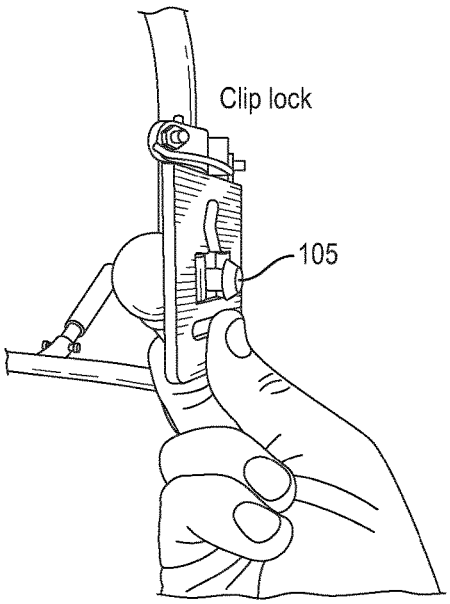

FIGS. 9A and 9B, and 10A and 10B, show schematic diagrams of the clips of the present disclosure, generically referenced as 90 and 100 but which may be interchanged with any of the aforementioned clip embodiments 30, 50, 70 of this disclosure, in which the clips are in an unmounted state (FIGS. 9A and 10A) and a mounted state (FIGS. 9B and 10B) with respect to attachment knobs 95 and 105 of spreader bars 99 and 109, respectively. Notably, FIGS. 9B and 10B illustrate the locking of clips 90, 100 in a single step by inserting connector 95, 105 in the corresponding apertures of clips 90, 100. In one embodiment, clip 90, 100 and their corresponding latches may be configured as or essentially function as a quick connect mechanism. The latches automatically lock to rotatably secure connector 95, 105 in the clip aperture immediately upon initial connection of connector 95, 105 to clip 90, 100. While connector 95, 105 may be subsequently moved to a terminus opening of the clip's key hole shaped aperture, this is optional and not necessary to ensure that clips 90, 100 are locked and rotatably secured to spreader bars 99, 109. Moreover, as discussed above, the two step clip release process in which: (a) the release mechanism of the clips 90, 100 is moved to an unlocked position allowing for rotation of the clip latches and (b) subsequent separation of the connector 90, 105 through apertures of clips 90, 100, ensures that the clips 90, 100 are not accidentally disengaged from spreader bars 99, 109.

Figure 11:
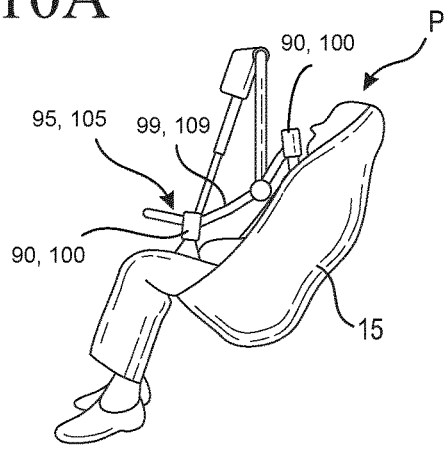
FIG. 11 shows a schematic diagram of a patient positioned in a patient sling that employs an attachment device disclosed herein.

FIG. 11 shows a schematic diagram in which a patient sling 15 is used to support a patient P. The attachment device of the present invention shown here as clip 90, 100 are operatively associated with and securely connect patient sling 15 to the spreader bar 99, 109. The clip 90, 100 is connected to the spreader bar 99, 109 via the connector 95, 105, which is attached to the spreader bar 99, 109. The connector 95, 105 is maintained within the aperture of the clip 90, 100 due to rotation of the latches to the spring-biased position, namely, the closed configuration. As described above, the connector 95, 105 may be removed from the aperture by rotating the latches to the open configuration using a release mechanism. While FIG. 11 illustrates clip 90, 100 in combination with connector 95, 105, any of the clips 30, 50 or 70 may be substituted for clip 95, 105 in accordance with this disclosure.

All optional and preferred features and modifications of the described embodiments and dependent claims are usable in all aspects of the invention taught herein. Furthermore, the individual features of the dependent claims, as well as all optional and preferred features and modifications of the described embodiments are combinable and interchangeable with one another.

The disclosure in the abstract accompanying this application is incorporated herein by reference.

The invention claimed is:

1. An attachment device for attaching a patient sling to a spreader bar, the device comprising:

a first attachment site attachable to an attachment element of the sling or the spreader bar;

a second attachment site attachable to the other one of the sling or the spreader bar;

a locking element that locks the attachment element to the first or second attachment site automatically upon initial connection of the attachment element to the first or second attachment site, wherein the locking element is configured to allow movement of the attachment element along an axis of movement into the first or second attachment site, and the locking element prevents removal of the attachment element from the first or second attachment site; and a release mechanism operable to allow removal of the attachment element, wherein the attachment device is configured to allow rotation of the attachment element about the axis of movement when the attachment element is locked in place, wherein the locking element is configured to move from a first position in which the locking element restricts access to the first attachment site to a second position in which the locking element allows access to the first attachment site, wherein the locking element is resiliently biased into the first position, and wherein operation of the release mechanism removes said resilient bias to allow the locking element to move from the first position to the second position.

2. The attachment device as claimed in claim 1, wherein the attachment device is formed generally on a plane, and wherein the axis of movement is substantially perpendicular to the plane.

3. The attachment device as claimed in claim 1, wherein the locking element is configured to rotate about an axis substantially perpendicular to the axis of movement in order to move from the first position to the second position.

4. The attachment device as claimed in claim 1, wherein the locking element is configured to move laterally along an axis substantially perpendicular to the axis of movement in order to move from the first position to the second position.

5. The attachment device as claimed in claim 1, wherein operation of the release mechanism allows the attachment element to move out of the first attachment site in a direction substantially perpendicular to the axis of movement, thereby bypassing the locking element, and wherein the attachment device further includes a channel in communication with the first attachment site along which the attachment element is able to move in order to bypass the locking element.

6. The attachment device as claimed in claim 1, further comprising a second locking element.

7. A kit of parts comprising an attachment device as claimed in claim 1, wherein the attachment element is removeably attachable to the attachment device.

8. The kit of parts as claimed in claim 7, wherein the attachment element is a knob having a flange and a recessed portion and wherein the locking element is configured to be seated in the recessed portion when the attachment element is locked in the first attachment site.

9. The kit of parts as claimed in claim 7, wherein both the attachment element and the first attachment site are circular in cross-section.

10. The kit of parts as claimed in claim 7, wherein the attachment element is attached to a spreader bar and the attachment device is attached to a patient sling.

11. A lift system comprising the attachment device as claimed in claim 1 and further comprising a spreader bar operatively associated with the attachment device.

12. The lift system of claim 10, further comprising a patient support sling operatively associated with the attachment device.

13. A patient sling comprising: an attachment device as claimed in claim 1 attached thereto.

14. A patient spreader bar comprising: an attachment device as claimed in claim 1 attached thereto.

15. An attachment device as claimed in claim 1, wherein the locking element is a quick connect coupling.

16. An attachment device for attaching a patient sling to a spreader bar, the device comprising:

a first attachment site attachable to an attachment element of the sling or the spreader bar;

a second attachment site attachable to the other one of the sling or the spreader bar;

a locking element that locks the attachment element to the first or second attachment site automatically upon initial connection of the attachment element to the first or second attachment site, wherein the locking element is configured to allow movement of the attachment element along an axis of movement into the first or second attachment site, and the locking element prevents removal of the attachment element from the first or second attachment site; and a release mechanism operable to allow removal of the attachment element, wherein the attachment device is configured to allow rotation of the attachment element about the axis of movement when the attachment element is locked in place, wherein operation of the release mechanism moves the locking element from the first to the second position.

* * * * *